US008240812B2

(12) United States Patent
Tsuyama

(10) Patent No.: US 8,240,812 B2
(45) Date of Patent: Aug. 14, 2012

(54) RECORDING APPARATUS

(75) Inventor: Kazuhiko Tsuyama, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 209 days.

(21) Appl. No.: 12/846,001

(22) Filed: Jul. 29, 2010

(65) Prior Publication Data

US 2011/0025756 A1 Feb. 3, 2011

(30) Foreign Application Priority Data

Jul. 30, 2009 (JP) ..... 2009-178051

(51) Int. Cl.
*B41J 2/165* (2006.01)

(52) U.S. Cl. ..... 347/35

(58) Field of Classification Search ..... None
See application file for complete search history.

(56) References Cited

U.S. PATENT DOCUMENTS

| | | | |
|---|---|---|---|
| 6,575,554 | B2 | 6/2003 | Yoshinaga |
| 6,910,757 | B2 | 6/2005 | Kanamitsu et al. |

FOREIGN PATENT DOCUMENTS

| | | |
|---|---|---|
| JP | 2002-187261 | 7/2002 |
| JP | 2004-009700 | 1/2004 |
| JP | 2004-082385 | 3/2004 |
| JP | 2005-028684 | 2/2005 |
| JP | 2005-103931 | 4/2005 |
| JP | 2005-262712 | 9/2005 |
| JP | 2010-017895 | 1/2010 |

*Primary Examiner* — Matthew Luu
*Assistant Examiner* — Alejandro Valencia
(74) *Attorney, Agent, or Firm* — Workman Nydegger

(57) ABSTRACT

A recording apparatus includes a recording head which discharges ink, an ink absorbing member which receives ink uselessly ejected by the recording head, directly from the recording head, or indirectly through another member, and a vibration application unit which applies vibration to the ink absorbing member.

5 Claims, 3 Drawing Sheets

RECORDING APPARATUS

BACKGROUND

1. Technical Field

The present invention relates to a recording apparatus which is represented by a facsimile machine, a printer, or the like. The invention particularly relates to a recording apparatus including an ink absorbing member which absorbs ink which is uselessly ejected outside a recording medium (hereinafter called "uselessly ejected") from a recording head.

2. Related Art

Hereinafter, an ink jet printer is specifically described as an example of a recording apparatus represented by a facsimile machine, a printer, or the like. There is an ink jet printer which makes it possible to perform so-called borderless recording. In the borderless recording, a recording sheet is recorded with no blank spaces at four sides in order to obtain an output result equivalent to silver print.

In the ink jet printer capable of performing such borderless recording, ink is also discharged (uselessly ejected) onto a region beyond the edge of the recording sheet. Therefore, recesses are formed on a sheet supporting member at a region on which ink is uselessly ejected. The sheet supporting member is provided so as to be opposed to an ink jet recording head and defines a distance between the recording sheet and the ink jet recording head by supporting the recording sheet.

The ink absorbing member which absorbs the uselessly ejected ink is arranged on each recess. Further, a discharge hole from which ink absorbed by each ink absorbing member is discharged downward is formed on the bottom of each recess. With this configuration, ink absorbed by each ink absorbing member is discharged onto a waste liquid tray from the discharge hole. The waste liquid tray is arranged at the lower side of the recesses.

Regardless of the borderless recording, a uselessly ejected region on which ink is uselessly ejected is assured in the ink jet printer in many cases (for example, useless ink ejection hole for flushing (empty discharge) operation). Then, ink uselessly ejected on the useless ink ejected region is discharged onto the waste liquid tray in the same manner.

The ink absorbing member which absorbs ink is arranged in the waste liquid tray. Ink is kept in the waste liquid tray so as not to leak the ink from the waste liquid tray even when the apparatus is tilted (for example, JP-A-2004-9700).

There are pigment-based ink and dye-based ink as ink discharged from the ink jet recording head. However, in the case of the pigment-based ink, the permeability into the ink absorbing member is not preferable due to the nature thereof. Therefore, in some cases, ink does not sufficiently permeate into the ink absorbing member and the ink solidifies on a surface of the ink absorbing member. Further, ink is gradually deposited on the surface of the ink absorbing member when the situation is repeated.

Then, as an amount of ink deposited on the surface of the ink absorbing member is increased, the deposited ink reaches to a back surface of the recording sheet supported by the sheet supporting member in time, resulting in contamination of the back surface. This may incur a risk that the recording quality is significantly deteriorated. Such problem will happen not only in the ink absorbing member arranged on the sheet supporting member which supports the recording sheet, but also in the ink absorbing member arranged at the lower side of the sheet supporting member.

SUMMARY

An advantage of some aspects of the invention is to provide a recording apparatus which makes it possible to accelerate permeation of uselessly ejected ink into an ink absorbing member and prevent ink from being deposited or suppress the ink deposition speed even when ink having poor permeability (for example, pigment-based ink) into the ink absorbing member is used.

According to a first aspect of the invention, a recording apparatus includes a recording head which discharges ink, an ink absorbing member which receives ink uselessly ejected by the recording head, directly from the recording head, or indirectly through another member, and a vibration application unit which applies vibration to the ink absorbing member.

According to the aspect, the recording apparatus includes the vibration application unit which applies vibration to the ink absorbing member which receives ink uselessly ejected by the recording head, directly from the recording head, or indirectly through another member. Therefore, permeation of ink into the ink absorbing member can be accelerated with the vibration so that good permeability can be obtained even when ink having high viscosity is used.

According to a second aspect of the invention, the recording apparatus according to the first aspect further includes a recording medium supporting member which is arranged so as to be opposed to the recording head and defines a distance between a recording medium and the recording head by supporting the recording medium. In the recording apparatus, a recess on which ink is uselessly ejected is formed on the recording medium supporting member while the ink absorbing member is arranged inside the recess, and the vibration applying unit includes a plate member which is arranged on bottom of the recess and applies vibration to the bottom of the ink absorbing member, and a vibration source which applies vibration to the plate member.

According to the aspect, vibration is applied to the ink absorbing member by the plate member which is in contact with the bottom of the ink absorbing member and applies vibration to the bottom thereof. This makes it possible to prevent an upper region of the ink absorbing member from being covered by the vibration application unit, and prevent area of the ink absorbing surface from being decreased.

According to a third aspect of the invention, in the recording apparatus according to the second aspect, the plate member is provided so as not to be in contact with the bottom of the recess.

According to the aspect, the plate member is provided so as not to be in contact with the bottom of the recess which is formed on the recording medium supporting member. This makes it possible to prevent the vibration from being applied to the recording medium supporting member by the plate member. Also, the rate of the vibration applied to the recording medium supporting member by the plate member can be reduced. Accordingly, deterioration of the recording quality, which is caused in accompanied with application of the vibration to the recording medium during recording, can be prevented. In addition, other components of the recording apparatus are not adversely affected because the vibration is not propagated to them.

According to a fourth aspect of the invention, the recording apparatus according to the second or the third aspect further includes an ink discharge hole which discharges ink downward on the bottom of the recess which is formed on the recording medium supporting member, a waste liquid absorbing member which is arranged on the lower side of the recording medium supporting member and absorbs ink discharged from the ink discharge hole, and a second vibration application unit which applies vibration to the waste liquid absorbing member.

When the waste liquid absorbing member which absorbs ink discharged from the recording medium supporting member is provided on the lower side of the recording medium supporting member, there is a risk of causing a problem that ink also solidifies on the waste liquid absorbing member. According to the aspect, vibration is applied to the waste liquid absorbing member. Therefore, permeation of ink not only into the ink absorbing member arranged on the recording medium supporting member, but also into the waste liquid absorbing member can be accelerated with the vibration. Accordingly, a good permeability can be obtained even when ink having high viscosity is used.

According to a fifth aspect of the invention, in the recording apparatus according to the above aspects, the vibration application unit is operated every time a recording job is terminated. According to the aspect, the vibration application unit is operated every time recording job is terminated. Therefore, ink can be more reliably prevented from solidifying on the surface of the ink absorbing member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
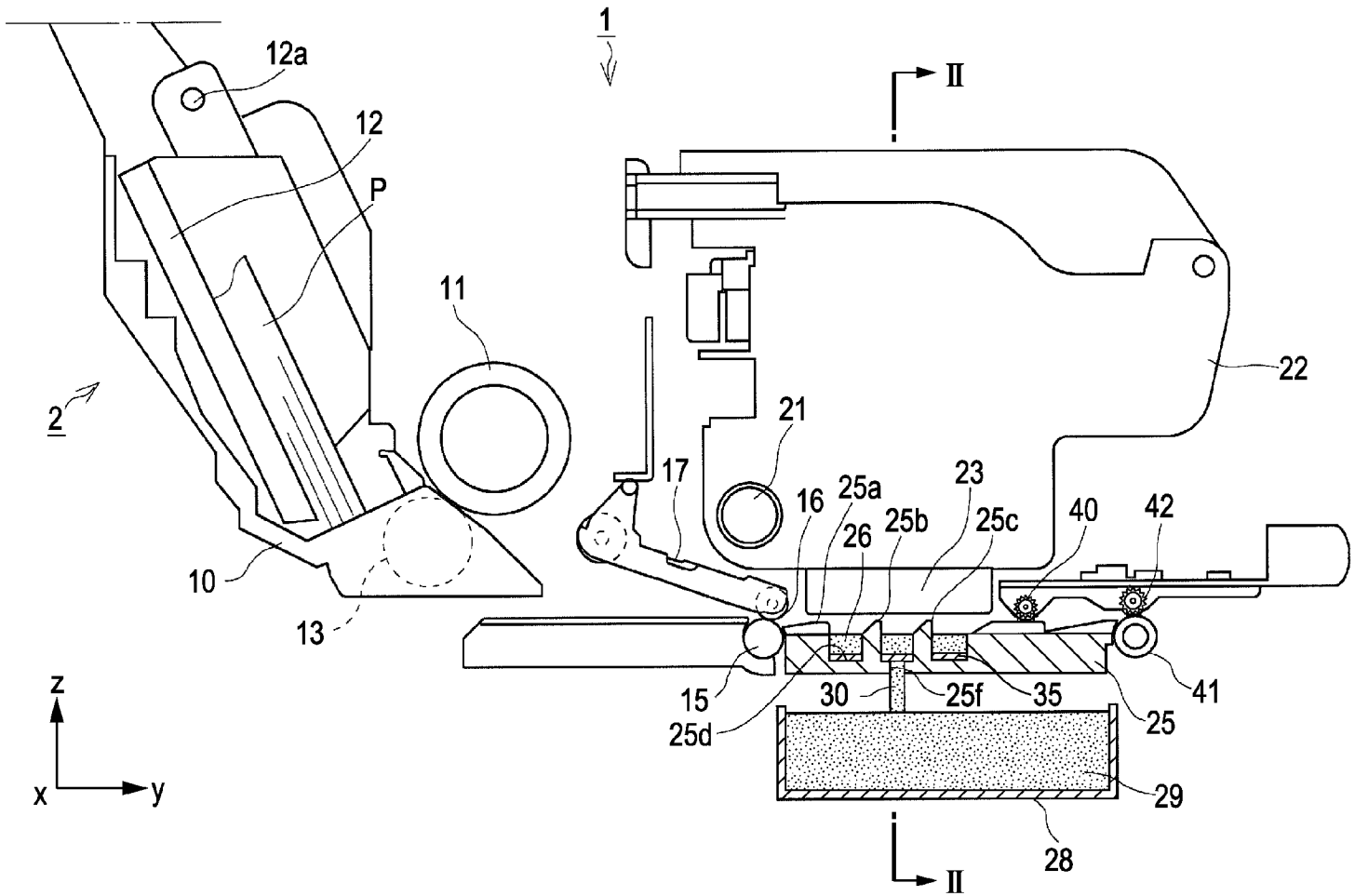
FIG. 1 is a side cross-sectional view schematically illustrating a sheet transportation path of an ink jet printer according to the invention.
Figure 2:
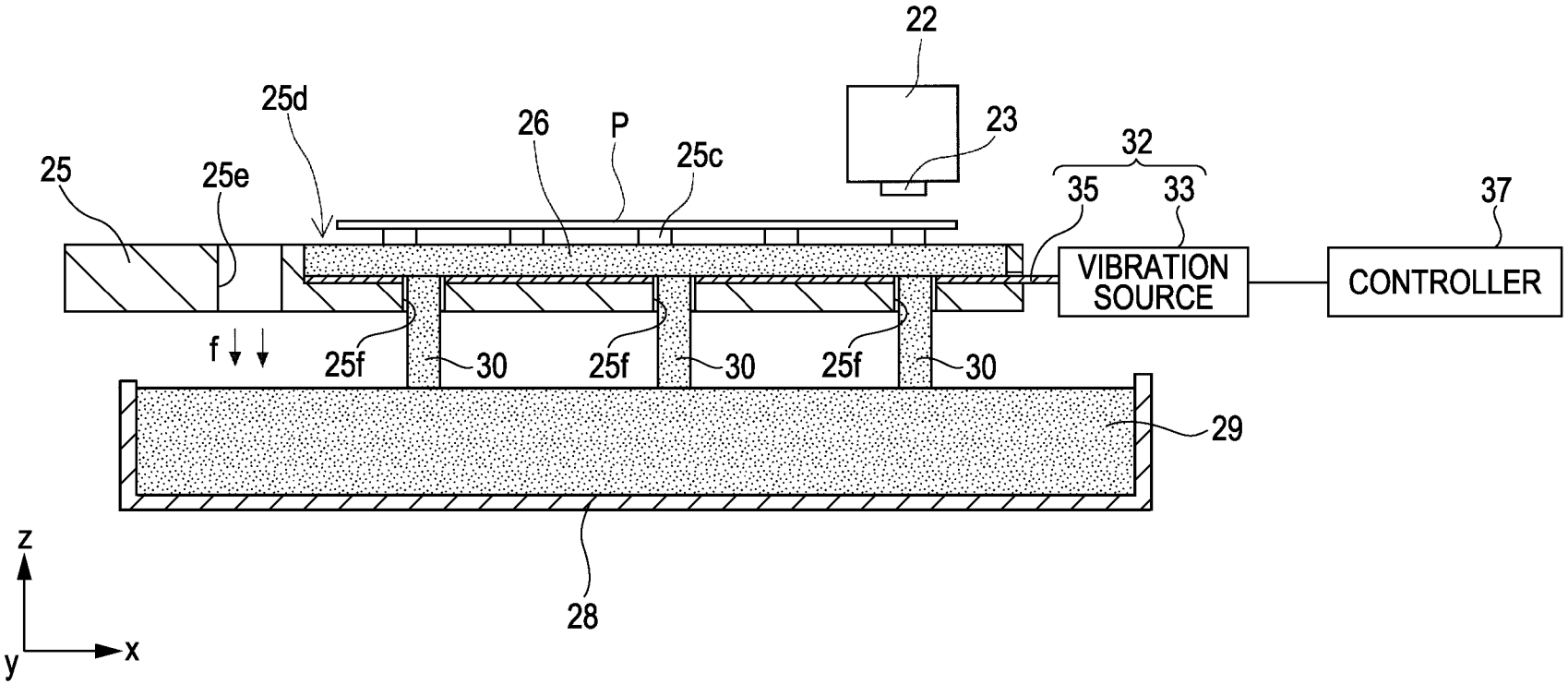
FIG. 2 is a cross-sectional view illustrating an essential part of the ink jet printer according to the invention (cross section cut along a line II-II of FIG. 1).
Figure 3:
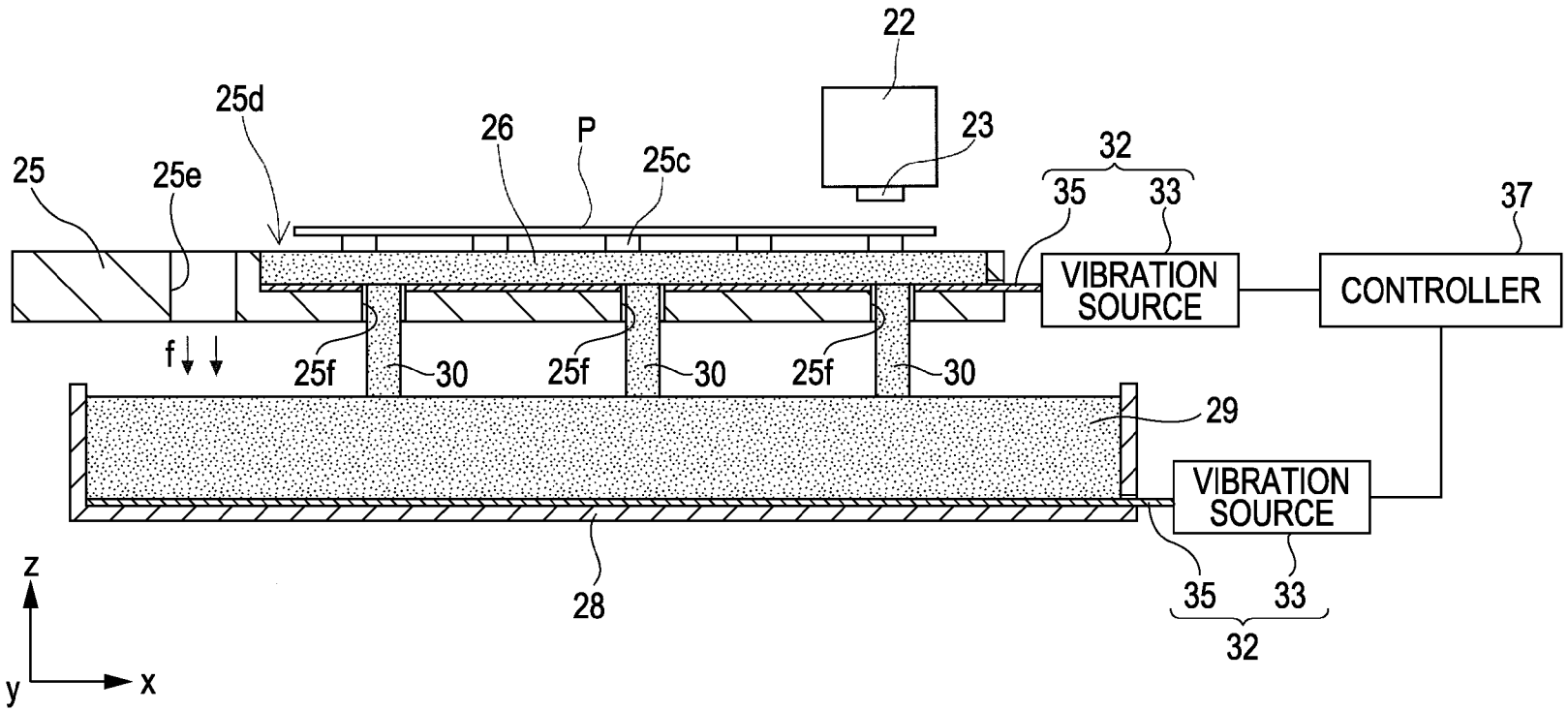
FIG. 3 is a view illustrating a modification of an embodiment as shown in FIG. 2.

Hereinafter, an embodiment of the invention will be described with reference to the drawings. FIG. 1 is a side cross-sectional view schematically illustrating a sheet transportation path of an ink jet printer 1 as an embodiment of a recording apparatus according to the invention. FIG. 2 is a cross-sectional view illustrating an essential part of the ink jet printer 1 (cross section cut along a line II-II of FIG. 1). FIG. 3 is a view illustrating a modification of the embodiment as shown in FIG. 2.

FIG. 1 to FIG. 3 illustrate an x-y-z coordinate system. The x-coordinate indicates a width direction of a sheet (scanning direction of an ink jet recording head 23). The y-coordinate indicates a transportation direction of the sheet. The z-coordinate indicates a height direction of the apparatus. In another embodiment illustrated in FIG. 3, same reference numerals as those in an embodiment illustrated in FIG. 2 designate the same components. Therefore, the description thereof is not repeated below.

Hereinafter, a configuration of the ink jet printer 1 is generally described at first. The ink jet printer 1 includes a feeding apparatus 2 on the rear of the apparatus, as shown in FIG. 1. The feeding apparatus 2 can set recording sheets (primarily single sheet: hereinafter, referred to as "sheet P") as an example of recording media in an inclined position.

The feeding apparatus 2 includes a feeding roller 11, a hopper 12 and a retard roller 13, all of which are on a base frame 10. The feeding roller 11 feeds the sheet P. The hopper 12 supports the sheet P in an inclined position and is capable of oscillating about an oscillating axis 12*a*. The retard roller 13 separates the sheet P.

The sheet P fed to the downstream side by the feeding apparatus 2 is nipped by a transportation driving roller 15 and a transportation driven roller 16. The transportation driving roller 15 is rotationally driven by a motor (not shown). The transportation driven roller 16 is drivenly rotated while being in contact with the transportation driving roller 15. Then, the sheet P is fed to a position opposed to the ink jet recording head 23 by the rotation of the transportation driving roller 15.

The transportation driven roller 16 is supported pivotally at a downstream end of an upper guide member 17 in a freely rotatable manner. The rotational center of the transportation driven roller 16 is set at a slightly downstream side rather than that of the transportation driving roller 15. Accordingly, the traveling direction of the sheet P fed to the downstream side by the transportation driving roller 15 and the transportation driven roller 16 is not in parallel with a head face of the ink jet recording head 23. The sheet P travels slightly downward, that is, toward the sheet supporting member 25. This configuration makes it possible to prevent the sheet P from being floated from the sheet supporting member 25.

The ink jet recording head 23 and the sheet supporting member 25 are provided on the downstream side of the transportation driving roller 15. The ink jet recording head 23 and the sheet supporting member 25 are arranged so as to be opposed to each other.

The ink jet recording head 23 is provided at the bottom of a carriage 22. The carriage 22 is driven so as to reciprocate in the width direction of the sheet by a driving motor (not shown) while the carriage 22 is guided by a carriage guide axis 21 extending in the width direction of the sheet.

Note that ink cartridges (not shown) which are independent of each of a plurality of colors are mounted on the carriage 22. Inks are supplied to the ink jet recording head 23 from these ink cartridges.

A first rib 25*a*, a second rib 25*b* and a third rib 25*c* are formed on the sheet supporting member 25 at a face opposed to the ink jet recording head 23. The first rib 25*a*, the second rib 25*b* and the third rib 25*c* are formed from the upstream side to the downstream side in this order, as shown in FIG. 1. The sheet P is supported by these ribs so that a distance between the sheet P and the ink jet recording head 23 is defined.

Recesses 25*d* are formed for uselessly ejecting ink when ink is discharged onto a region beyond the edge (end) of the sheet P. For example, when a so-called borderless recording in which the sheet P is recorded with no blank spaces at edges is performed, ink is also discharged onto the region beyond the sheet edge in a state where the sheet edge is positioned above the recess 25*d*. In such a manner, the borderless recording on the sheet edges is performed.

At this time, ink discharged (uselessly ejected) onto the region beyond the sheet edge is trapped by the ink absorbing member 26 arranged on each recess 25*d*. The trapped ink is discharged downward from an ink discharge hole 25*f* formed at the bottom of each recess 25*d*.

A through hole 25*e* is formed on the sheet supporting member 25, as shown in FIG. 2. The through hole 25*e* is provided on the outside of the recording region where recording is performed on the sheet P and used at the time of flushing (empty discharge) operation of the ink jet recording head 23. Ink uselessly ejected at this time drops on the lower side of the through hole 25*e* as shown by arrows f so that the dropped ink is absorbed by a waste liquid absorbing member 29 which is provided at the lower side of the sheet supporting member 25.

The waste liquid absorbing member 29 is arranged on a waste liquid tray 28. The waste liquid absorbing member 29 is formed with a material capable of absorbing ink discharged from the ink jet recording head 23. For example, the waste liquid absorbing member 29 is formed with a material having ink absorbability such as an unwoven fabric or a sponge.

The unwoven fabric or the sponge having a property of not easily affected (having high ink resistance) is preferable. For example, a polyester fiber, a polypropylene fiber, a polyethylene fiber, or the like can be applied as the unwoven fabric used.

As a material of the ink absorbing members 26 arranged on the sheet supporting member 25, a material having high ink resistance is also preferable to be used. Further, the material of the ink absorbing members 26 may be same as or different from that of the waste liquid absorbing member 29.

The waste liquid absorbing member 29 directly receives ink from the ink jet recording head 23 at a lower side of the through hole 25*e* formed on the sheet supporting member 25. On the other hand, the waste liquid absorbing member 29 indirectly receives inks discharged from the ink discharge holes 25*f* through ink conducting members 30.

Lower ends of the ink conducting members 30 are in contact with an upper surface of the waste liquid absorbing member 29. Therefore, inks discharged from the ink discharge holes 25*f* are effectively conducted to the ink conducting members 30.

That is to say, if ink naturally drops from each ink discharge hole 25*f*, the ink is not discharged downward unless a constant amount of ink is accumulated on the bottom of each ink absorbing member 26. However, ink absorbing forces of the ink conducting members 30 and the waste liquid absorbing member 29 act on the ink absorbing members 26 by providing the ink conducting members 30 and making the lower ends of the ink conducting members 30 contact with the ink absorbing member 29. Therefore, inks are discharged downward smoothly. It is to be noted that a material having ink absorbability as in the materials of the ink absorbing members 26 and the waste liquid absorbing member 29 can be used for a material of the ink conducting members 30.

Subsequently, referring again to FIG. 1, an auxiliary roller 40, a discharge driving roller 41, and a discharge driven roller 42 are provided on the downstream side of the ink jet recording head 23. The auxiliary roller 40 is freely rotatable so as to prevent the sheet P from being floated from the sheet supporting member 25. The discharge driving roller 41 which is driven by a motor (not shown) is located on the further downstream side of the auxiliary roller 40. The discharge driven roller 42 is drivenly rotated while being in contact with the discharge driving roller 41. The sheet P on which the recording has been performed is discharged to the outside of the apparatus by the rotation of the discharge driving roller 41.

Hereinabove, a schematic configuration of the ink jet printer 1 has been described. A vibration application unit 32 including a plate member 35 and a vibration source 33 will be described with reference to FIG. 2 below.

The plate member 35 is arranged on the recess 25*d* of the sheet supporting member 25. The plate member 35 is formed with a material having good vibration transmissibility such as a metal plate. Further, the plate member 35 is formed into a shape which coincides with a plane shape of the recess 25*d* (planar view is not shown).

The plate member 35 is provided so as to have a slight clearance with respect to the bottom of the recess 25*d*. That is, the plate member 35 is provided so as not to be in contact with the bottom of the recess 25*d*. As methods of providing the plate member 35 so as not to be in contact with the bottom of the recess 25*d* as described above, the following methods are exemplified. For example, a cantilever supporting configuration in which an end projecting from the sheet supporting member 25 is supported may be employed, or a buffer material (such as a sponge) may be arranged between the plate member 35 and the bottom of the recess 25*d*.

The ink absorbing member 26 arranged on the recess 25*d* is placed on the plate member 35. Through holes are formed at positions where the ink discharge holes 25*f* are formed on the plate member 35. Ink absorbed by the ink absorbing member 26 can move to the lower side of the plate member 35 through the through holes so as to be discharged downward from the ink discharge holes 25*f*.

One side end of the plate member 35 in the lengthwise direction projects from the side of the sheet supporting member 25. The vibration source 33 is connected to the projected end. The vibration source 33 applies vibration to the plate member 35. ON/OFF switching of the vibration source 33 is performed by a controller 37. The controller 37 is connected to a control unit (not shown) which controls the entire ink jet printer 1. The control unit can drive the vibration source 33 at arbitrary timings.

The vibration source 33 is driven so that vibration is applied to the ink absorbing member 26 through the plate member 35. Accordingly, even if ink discharged from the ink jet recording head 23 has high viscosity (for example, pigment-based ink), ink can permeate into the ink absorbing member 26 before solidifying on the upper surface of the ink absorbing member 26. Further, the ink can be guided to the waste liquid absorbing member 29 which is located at a lower side of the ink absorbing member 26.

In the embodiment, a configuration where the plate member 35 is in contact with the bottom of the ink absorbing member 26 so as to apply vibration to the ink absorbing member 26 is employed. This makes it possible to prevent the upper region of the ink absorbing member 26 from being covered by the vibration application unit 32, and prevent area of the ink absorbing surface (surface of the ink absorbing member 26) from being decreased.

Further, in the embodiment, the plate member 35 is provided so as not to be in contact with the bottom of the recess 25*d*. This makes it possible to prevent the vibration from being applied to the sheet supporting member 25 by the plate member 35. Also, the rate of the vibration applied to the sheet supporting member 25 by the plate member 35 can be reduced. Accordingly, deterioration of the recording quality, which is caused in accompanied with application of the vibration to the sheet P during recording, can be prevented. In addition, other components of the ink jet printer 1 are not adversely affected because the vibration is not propagated to them.

Although the dedicated vibration source 33 is used in the above embodiment, existing components of the ink jet printer 1 can be used. For example, a configuration in which power from the transportation driving roller 15 is received so as to generate vibration in accompanied with the rotation of the transportation driving roller 15 can be employed.

Further, the vibration application unit 32 is applied to the ink absorbing member 26 provided on the sheet supporting member 25 in the embodiment. However, the vibration application unit 32 can be applied to the waste liquid absorbing member 29 provided on the lower side of the sheet supporting member 25 (second vibration application unit).

With the second vibration application unit, absorption of ink into the waste liquid absorbing member 29 can be accelerated. Therefore, even if ink discharged from the ink jet recording head 23 has high viscosity (for example, pigment-based ink), ink can be permeated into the waste liquid absorbing member 29 before solidifying on the surface of the waste liquid absorbing member 29. Note that although the vibration application units are applied to both the ink absorbing member 26 and the waste liquid absorbing member 29 in an example of FIG. 3, the vibration application unit can be applied only to the waste liquid absorbing member 29.

In addition, lower ends of the ink conducting members 30 are in contact with an upper surface of the waste liquid absorbing member 29 in the embodiment. Therefore, when vibration is applied to the waste liquid absorbing member 29, the vibration is propagated to the ink conducting members 30. As a result, inks flown from the sheet supporting member 25 to the waste liquid absorbing member 29 through the ink conducting members 30 can be further accelerated.

Solidification of ink can be prevented more reliably by operating the vibration application unit 32 every time a series of recording job is terminated immediately after the recording job is terminated. In particular, it is preferable that the vibration application unit 32 be operated immediately after the borderless recording on the sheet P is performed, from the viewpoint of prevention of the ink solidification.

Alternatively, when the flushing operation is performed on the through hole 25*e*, ink can be prevented from solidifying and can be smoothly absorbed into the ink absorbing member 26 or the waste liquid absorbing member 29 by operating the vibration application unit 32 immediately after the flushing operation. In addition, the vibration application unit 32 can be operated at various timings. For example, the vibration application unit 32 can be operated at the timing of turning off the power of the ink jet printer 1. The embodiment described above is merely an example and various modifications can be further realized.

What is claimed is:

1. A recording apparatus comprising:

a recording head which discharges ink;

an ink absorbing member which receives ink uselessly ejected by the recording head, directly from the recording head, or indirectly through another member; and a vibration application unit which applies vibration to the ink absorbing member.

2. The recording apparatus according to claim 1, further comprising a recording medium supporting member which is arranged so as to be opposed to the recording head and defines a distance between a recording medium and the recording head by supporting the recording medium, wherein a recess on which ink is uselessly ejected is formed on the recording medium supporting member while the ink absorbing member is arranged inside the recess, and the vibration applying unit includes a plate member which is arranged on the bottom of the recess and applies vibration to the bottom of the ink absorbing member, and a vibration source which applies vibration to the plate member.

3. The recording apparatus according to claim 2, wherein the plate member is provided so as not to be in contact with the bottom of the recess.

4. The recording apparatus according to claim 2, in which an ink discharge hole which discharges ink downward is formed on the bottom of the recess formed on the recording medium supporting member, the recording apparatus further comprising:

a waste liquid absorbing member which is arranged on the lower side of the recording medium supporting member and absorbs ink discharged from the ink discharge hole; and a second vibration application unit which applies vibration to the waste liquid absorbing member.

5. The recording apparatus according to claim 1, wherein the vibration application unit is operated every time a recording job is terminated.

* * * * *